US006386732B1

(12) United States Patent
Shiau

(10) Patent No.: US 6,386,732 B1
(45) Date of Patent: May 14, 2002

(54) FLASHLIGHT WITH A LAMP BASE MODULE MOUNTED FIXEDLY IN A BARREL THEREOF

(76) Inventor: Shoei-Shuh Shiau, No. 10, Alley 1, Lane 551, Sec. 1, Wan-Shou Rd., Kuei-Shan Hsiang, Taoyuan Hsien (TW)

( * ) Notice: Subject to any disclaimer, the term of this patent is extended or adjusted under 35 U.S.C. 154(b) by 0 days.

(21) Appl. No.: 09/613,794

(22) Filed: Jul. 11, 2000

(30) Foreign Application Priority Data

Dec. 23, 1999 (TW) ..... 088221934

(51) Int. Cl.[7] ..... F21L 7/00

(52) U.S. Cl. ..... 362/202; 362/203; 362/204; 362/206; 362/208

(58) Field of Search ..... 362/204, 203, 362/206, 202, 208; 200/60; 313/318

(56) References Cited

U.S. PATENT DOCUMENTS 4,942,505 A 7/1990 Maglica ..... 362/187
5,213,408 A * 5/1993 Shiau ..... 362/187
5,293,307 A * 3/1994 Maglica ..... 362/205
5,499,172 A * 3/1996 Shiau ..... 362/187
5,560,705 A * 10/1996 Shiau ..... 362/188
6,196,698 B1 * 3/2001 Maglica ..... 362/205

* cited by examiner

*Primary Examiner*—Sandra O'Shea
*Assistant Examiner*—Anabel Ton
(74) *Attorney, Agent, or Firm*—Foley & Lardner

(57) ABSTRACT

A flashlight includes a lamp base module disposed in a conductive barrel for seating a lamp thereon. The lamp base module includes a first insulator base member having first and second terminal receiving holes. First and second conductors are mounted in the terminal receiving holes, respectively. A hollow conductive seat is disposed above the first insulator base member, and has an upright wall portion establishing electrical contact with the barrel, and a flange portion that extends radially and inwardly from a bottom end of the upright wall portion and that contact electrically the first conductor. A second insulator base member has two coupling arms extending into two base coupling holes in the first insulator base member for coupling together the first and second insulator base members. The second insulator base member has two terminal extension holes to permit extension of two lamp terminals of a lamp for enabling electrical connection between the lamp terminals and the first and second conductors.

13 Claims, 8 Drawing Sheets

FLASHLIGHT WITH A LAMP BASE MODULE MOUNTED FIXEDLY IN A BARREL THEREOF

BACKGROUND OF THE INVENTION

1. Field of the Invention

The invention relates to a flashlight, more particularly to a flashlight with a lamp base module mounted fixedly in a barrel thereof.

2. Description of the Related Art

Referring to FIGS. 1 and 2, a flashlight 1 according to U.S. Pat. No. 4,942,505 is shown to include a conductive barrel 11 which defines a battery receiving space therein, a head assembly 15 mounted on an upper end of the barrel 11, a lamp base module mounted in the barrel 11 proximate to the upper end thereof, and a tail assembly 14 mounted removably on a lower end of the barrel 11 and provided with a biasing spring 141 for biasing a battery unit 2 toward the lamp base module.

As illustrated, the lamp base module includes a first insulator base member 12 inserted into the barrel 11 from the lower end thereof, a second insulator base member 13 inserted into the barrel 11 from the upper end thereof, a first conductor 16, a second conductor 17, and a lamp 3. The first insulator base member 12 has top and bottom sides, and first and second conductor receiving holes which extend through the top and bottom sides. The first conductor 16 is mounted in the first conductor receiving hole in the first insulator base member 12, and has an end portion that extends radially and along the top side of the first insulator base member 12 for abutting electrically against an annular inward flange 110 of the barrel 11. The second conductor 17 is mounted in the second conductor receiving hole in the first insulator base member 12, and has an end portion that extends radially and along the bottom side of the first insulator base member 12 for abutting electrically against the battery unit 2 disposed in the barrel 11. The second insulator base member 13 includes an annular plate 130 which abuts against the flange 110 of the barrel 11 and which is formed with two terminal extension holes 131 respectively aligned with the conductor receiving holes in the first insulator base member 12. The second insulator base member 13 further has a pair of spaced apart retention claws 132 extending integrally from the plate 130 and through the flange 110 of the barrel 11 into two claw holes 121 in the first insulator base member 12. Two lamp terminals 31,32 of the lamp 3 extend through the terminal extension holes 131 in the second insulator base member 13 and the conductor receiving holes in the first insulator base member 12 to contact electrically the first and second conductors 16,17. Under such a condition, rotation of the head assembly 15 relative to the barrel 11 will result in contact or non-contact between the flange 110 of the barrel 11 and the first conductor 16, thereby controlling illumination or non-illumination of the lamp 3.

Some of the disadvantages of the aforesaid conventional flashlight are as follows:

(1) The first and second insulator base members 12,13 are separately inserted into the barrel 11 from the upper and lower ends thereof prior to mounting of the head and tail assemblies 15,14, thereby resulting in inconvenience during assembly of the lamp base module into the barrel 11.

(2) The production process of the conventional flashlight 1 is complicated, because an insulated coating on an inner wall surface of the barrel 11 must be manually etched in order to permit an end portion of the first conductor 16 to contact electrically the inward flange 110 of the barrel 11.

(3) The production cost is high, because a special mold is required for making the barrel 11 with the inward flange 110.

Referring to FIGS. 3 and 4, another conventional flashlight 4 is shown to include a lamp base module 42 disposed in a conductive barrel 41 prior to the mounting of tail and head assemblies 44,43 on two opposite ends of the barrel 41.

As illustrated, the lamp base module 42 includes a first insulator base member 421 formed with two conductor receiving holes 4210 within which first and second conductors 4212,4213 are disposed. The first conductor 4212 has a bent portion in electrical contact with the barrel 41. A second insulator base member 422 has a pair of coupling arms 4222 which extend slidably through two coupling extension holes 4211 in the first insulator base member 421 to abut against a reflector 440 of the head assembly 44, and a base plate formed with a conductive seat 4221 that is in electrical contact with a battery unit 2 disposed in the barrel 41 and the second conductor 4213 in the first insulator base member 421. A lamp 45 is mounted on the top side of the first insulator base member 421, and has two terminals 451,452 extending into the conductor receiving holes 4210 in the first insulator base member 421 to connect electrically with the first and second conductors 4212,4213. Under such a condition, rotation of the head assembly 44 relative to the barrel 41 will result in movement of the second insulator base member 422 relative to the first insulator base member 421 to control contact or non-contact between the conductive seat 4221 of the second insulator base member 422 and the second conductor 4213.

Some drawbacks of the aforesaid conventional flashlight 4 are as follows:

(1) After the lamp base module 42 is disposed in the upper end of the barrel 41, the latter is punched inwardly and radially from an exterior thereof so as to form an inward flange that engages the first insulator base member 421, thereby preventing axial movement of the lamp base module 42 in the barrel 41. This somewhat inconveniences the production of the conventional flashlight 4. In addition, in case the strength of punching is excessively strong, the second insulator base member 422 might be hindered from moving relative to the first insulator base member 421. This can affect proper operation of the flashlight 4.

(2) An insulated coating on an inner wall surface of the barrel 41 must be manually etched in order to permit the bent portion of the first conductor 4212 to contact electrically the barrel 41. Such a process further increases the manufacturing cost of the conventional flashlight 4.

In order to eliminate the aforesaid drawbacks, another conventional flashlight has been proposed, as best shown in FIG. 5, which includes a lamp base module 9 mounted in a conductive barrel 90 proximate to an upper end thereof. The lamp base module 9 includes a first insulator base member 91 having first and second conductor receiving holes 910 within which first and second conductors 913,914 are disposed. A hollow conductive seat 93 is sleeved on the first insulator base member 91, and has an upright wall 931 in electrical contact with the barrel 90 and the first conductor 913. A second insulator base member 92 has two coupling arms 920 that extends through the conductive seat 93 and two coupling extension holes 911 in the first insulator base member 91. A lamp 94 is mounted on a top side of the first insulator base member 91, and has two lamp terminals 940 extending into the conductor receiving holes 910 to connect electrically with the first and second conductors 913,914. A battery unit disposed in the barrel 90 can connect electrically with the second conductor 914 via a conductive contact 921 on the second insulator base member 92.

The conductive seat 93 is provided with a pair of outwardly and radially extending claws 932 such that during insertion into the barrel 90, an insulated coating of the barrel 90 will be scratched off so as to establish electrical contact between the conductive seat 93 and the barrel 90. However, the following disadvantages are present in this conventional flashlight:

(1) The conductive seat 93 may disengage from the barrel 90 since there is no positioning device provided between the barrel 90 and the conductive seat 93.

(2) In case, the hollow conductive seat 93 is slightly oversized, and is forced into the barrel 90, this can result in an inward radial pressure on the first and second insulator base members 91, 92, thereby leading to unsteady movement of the second insulator base member 92 relative to the first insulator base member 91 and to improper operation of the flashlight.

SUMMARY OF THE INVENTION

Therefore, the object of this invention is to provide a flashlight with a lamp base module which is clear of the disadvantages mentioned beforehand.

Accordingly, the flashlight of the present invention includes a conductive barrel, a lamp, and a lamp base module. The barrel has top and bottom end portions and adapted for housing a battery unit therein. The lamp has a pair of lamp terminals. The lamp base module is mounted in the top end portion of the barrel, and includes first and second insulator base members, first and second conductors, and a hollow conductive seat. The first insulator base member has top and bottom sides, first and second terminal receiving holes that extend from the top side toward the bottom side, and a pair of base coupling holes that extend from the top side toward the bottom side. The first conductor is mounted in the first terminal receiving hole in the first insulator base member, and has an end portion that extends radially along the top side of the first insulator base member. The second conductor is mounted in the second terminal receiving hole, and has an end portion that extends radially along the bottom side of the first insulator base member and that is adapted to establish electrical contact with the battery unit housed in the barrel. The conductive seat is disposed above the first insulator base member, and has an upright wall portion that contacts fittingly and electrically the barrel, and a flange portion that extends radially and inwardly from a bottom end of the upright wall portion and that is disposed on top of the end portion of the first conductor so as to establish electrical contact therewith. The second insulator base member is disposed in the conductive seat, and has top and bottom sides, and first and second terminal extension holes that extend from the top side to the bottom side and that are aligned respectively with the first and second terminal receiving holes in the first insulator base member. The lamp terminals of the lamp extend respectively through the first and second terminal extension holes in the second insulator base member and into the first and second terminal receiving holes in the first insulator base member, and establish electrical connection with the first and second conductors, respectively. The second insulator base member further has a pair of coupling arms that extend into the base coupling holes in the first insulator base member for coupling together the first and second insulator base members.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTION OF THE PREFERRED EMBODIMENTS

Figure 1:
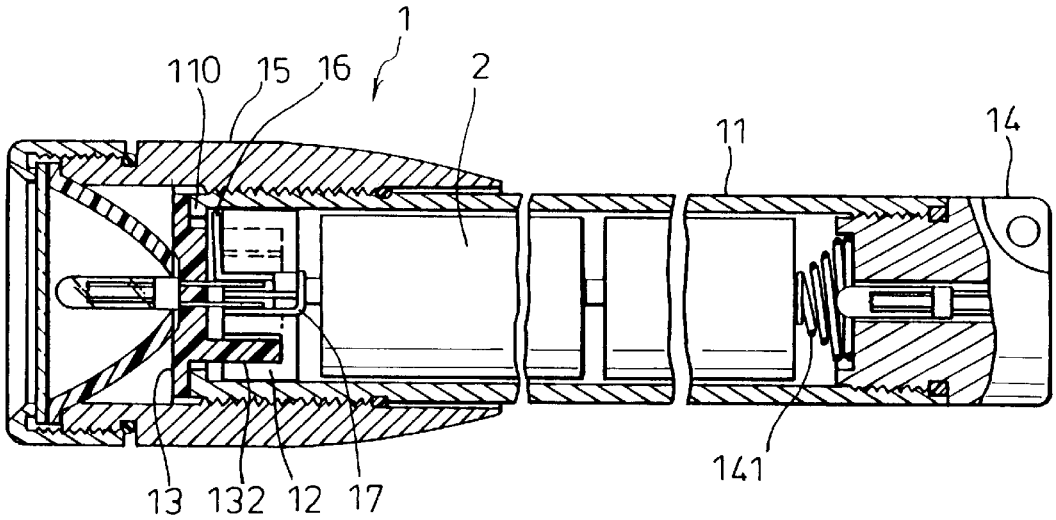
FIG. 1 PRIOR ART
FIG. 1 is a fragmentary and sectional view of a flashlight disclosed in U.S. Pat. No. 4,942,505.
Figure 2:
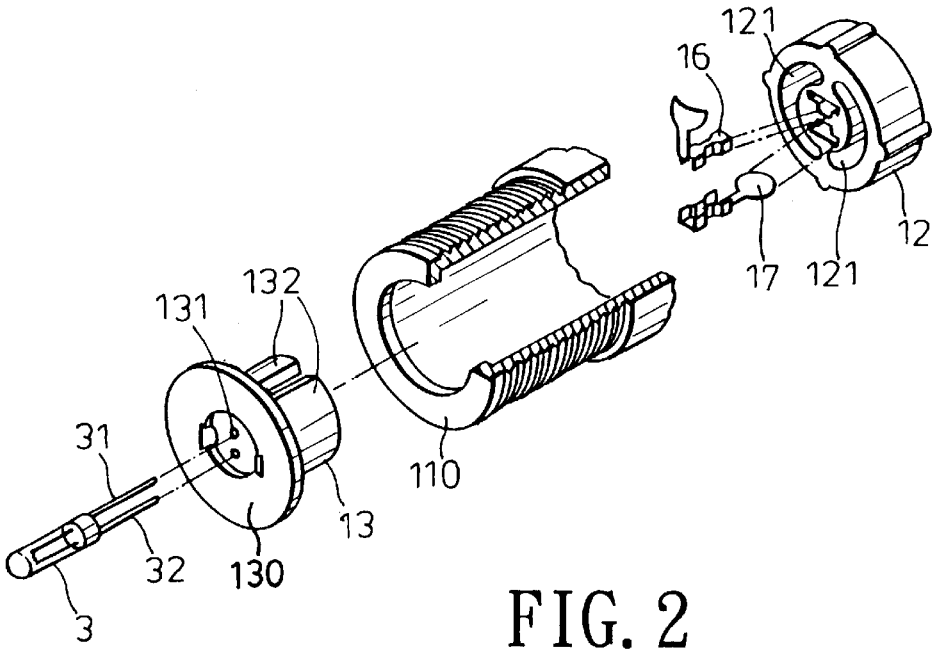
FIG. 2 PRIOR ART
FIG. 2 is an exploded view of a lamp base module employed in the flashlight shown in FIG. 1.
Figure 3:
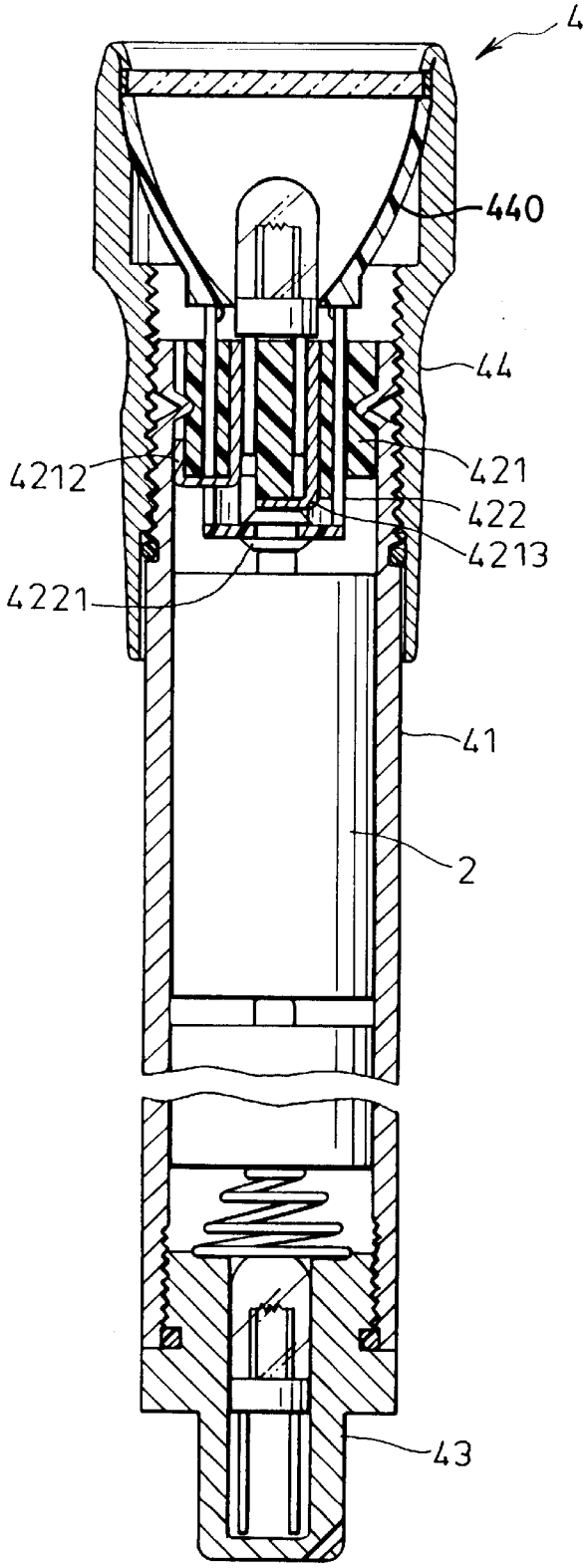
FIG. 3 PRIOR ART
FIG. 3 is a fragmentary sectional view of another conventional flashlight.
Figure 4:
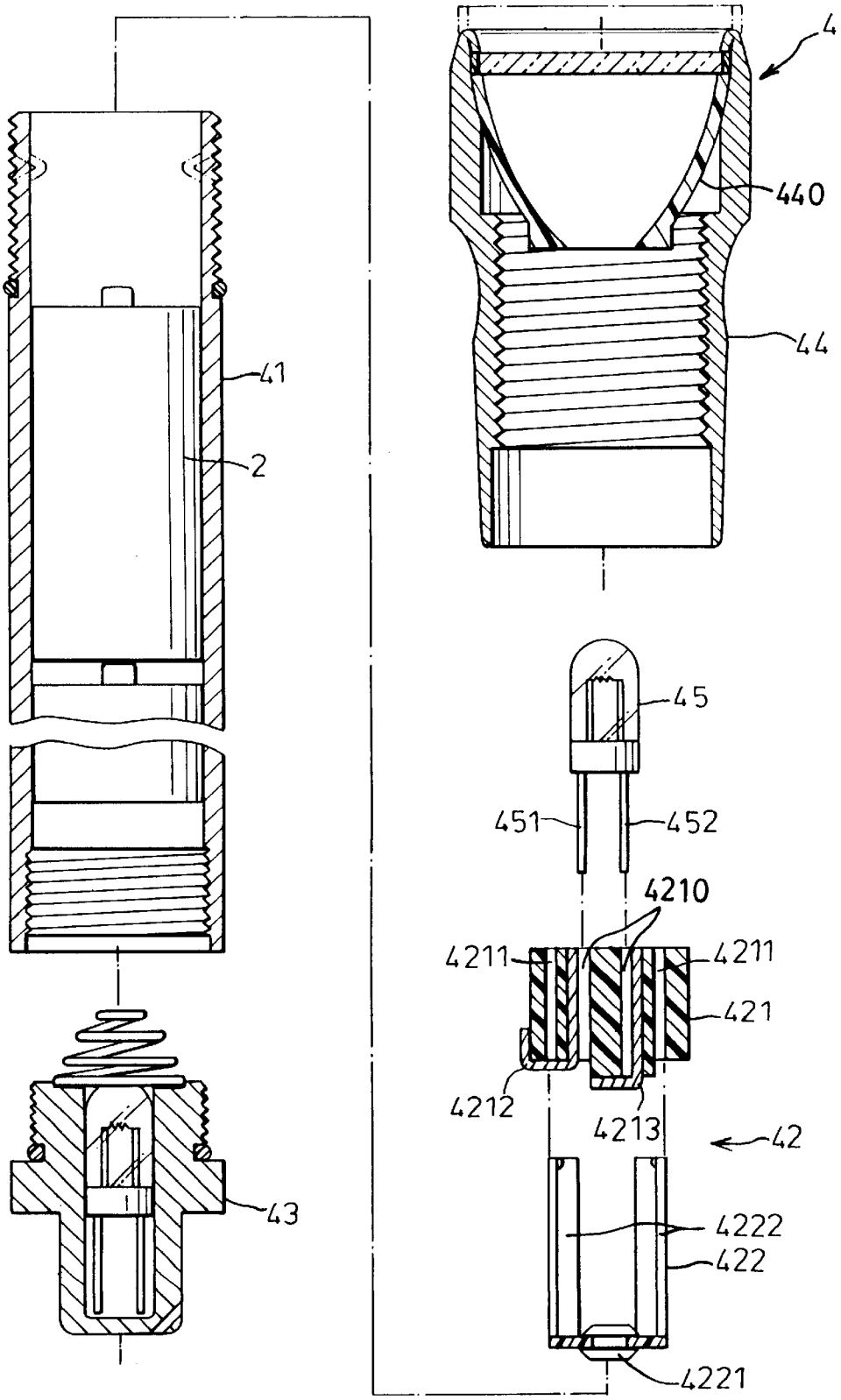
FIG. 4 PRIOR ART
FIG. 4 is an exploded view of the conventional flashlight shown in FIG. 3.
Figure 5:
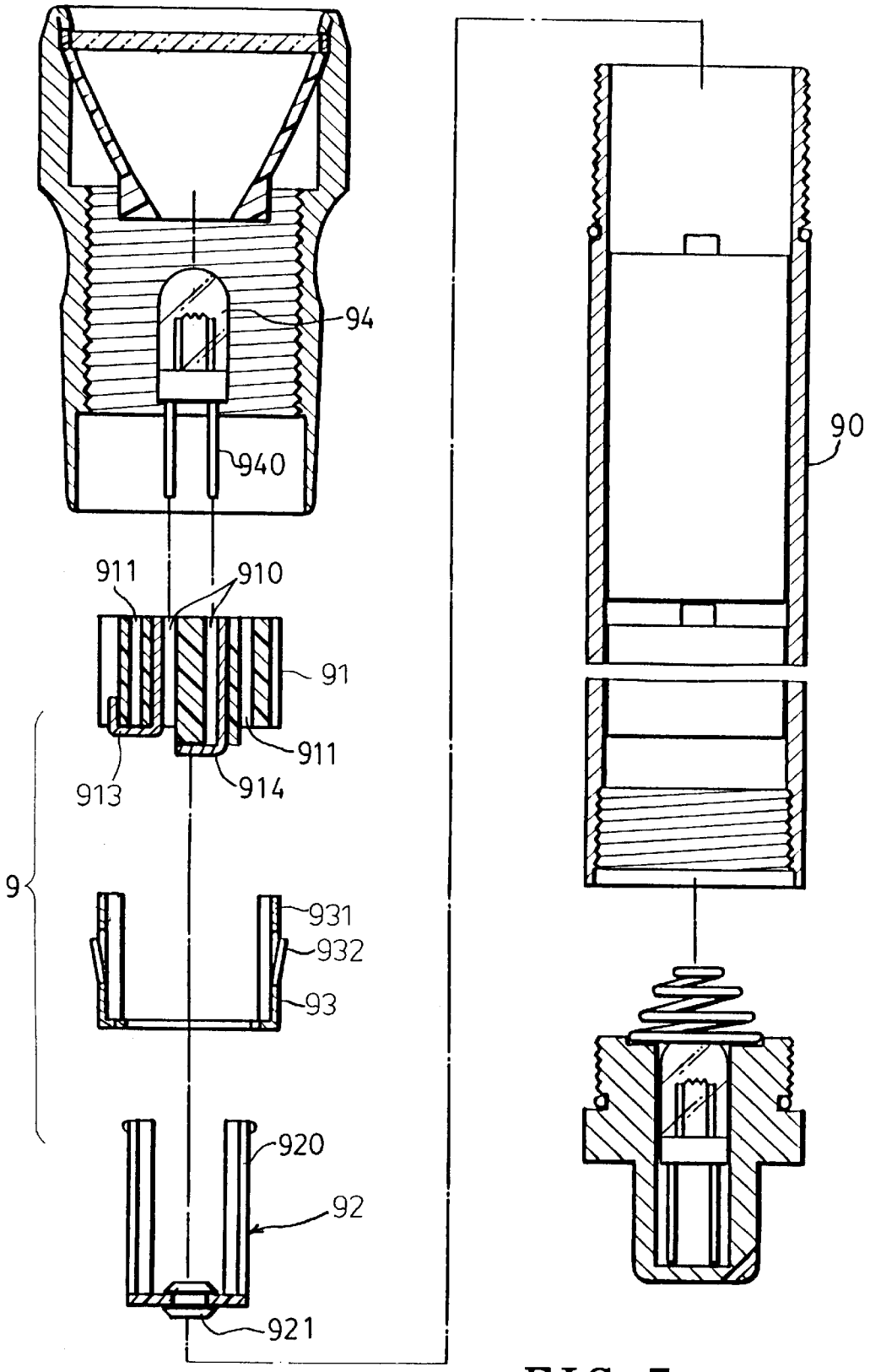
FIG. 5 PRIOR ART
FIG. 5 is an exploded view of yet another conventional flashlight.
Figure 6:
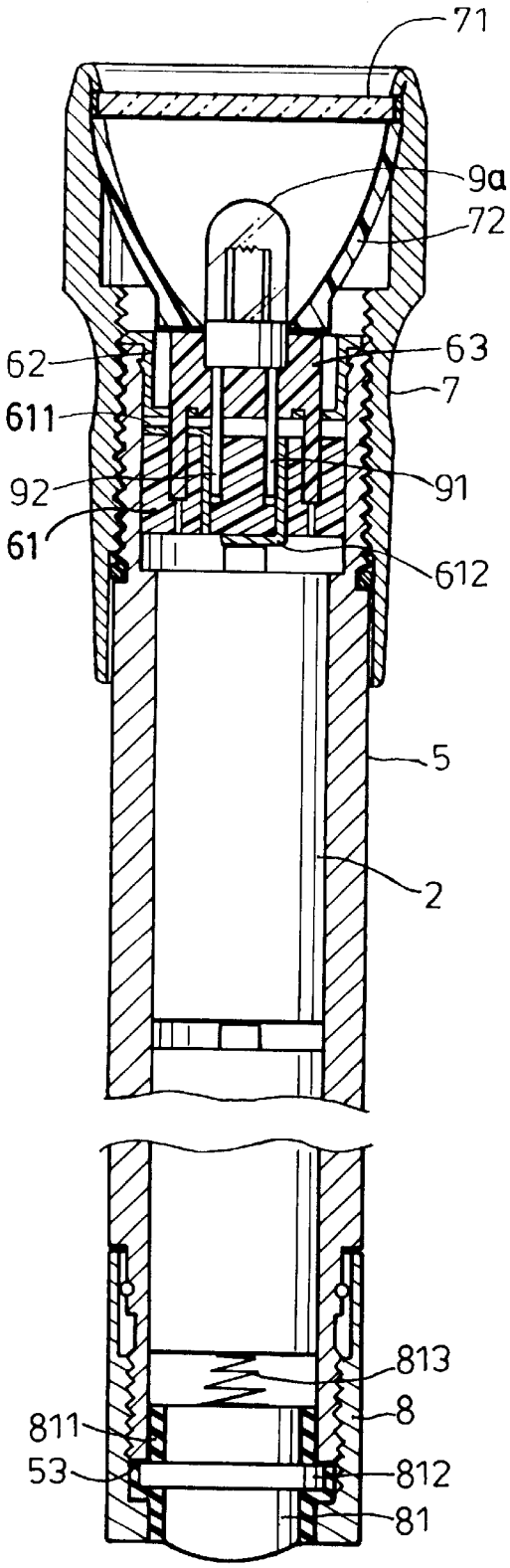
FIG. 6 is a fragmentary sectional view of the preferred embodiment of a flashlight according to the present invention.
Figure 7:
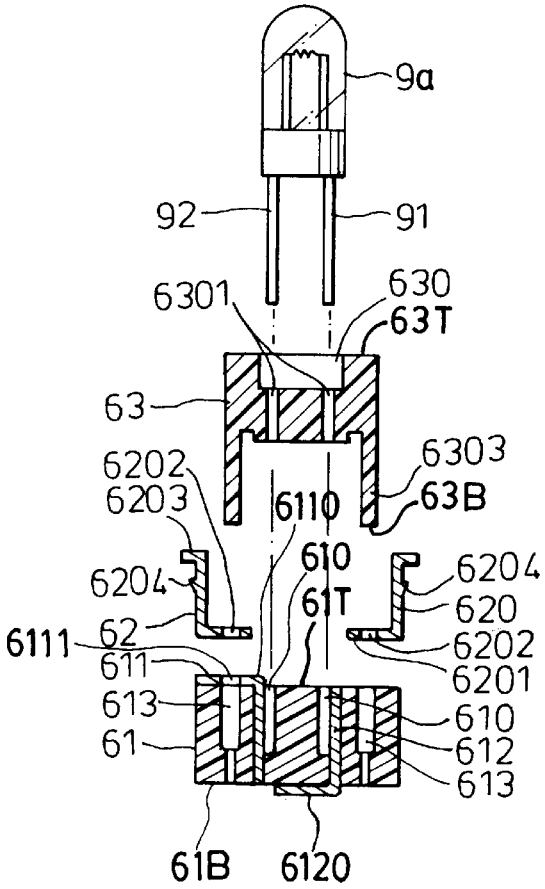
FIG. 7 illustrates an exploded view of a lamp base module employed in the preferred embodiment shown in FIG. 6.
Figure 8:
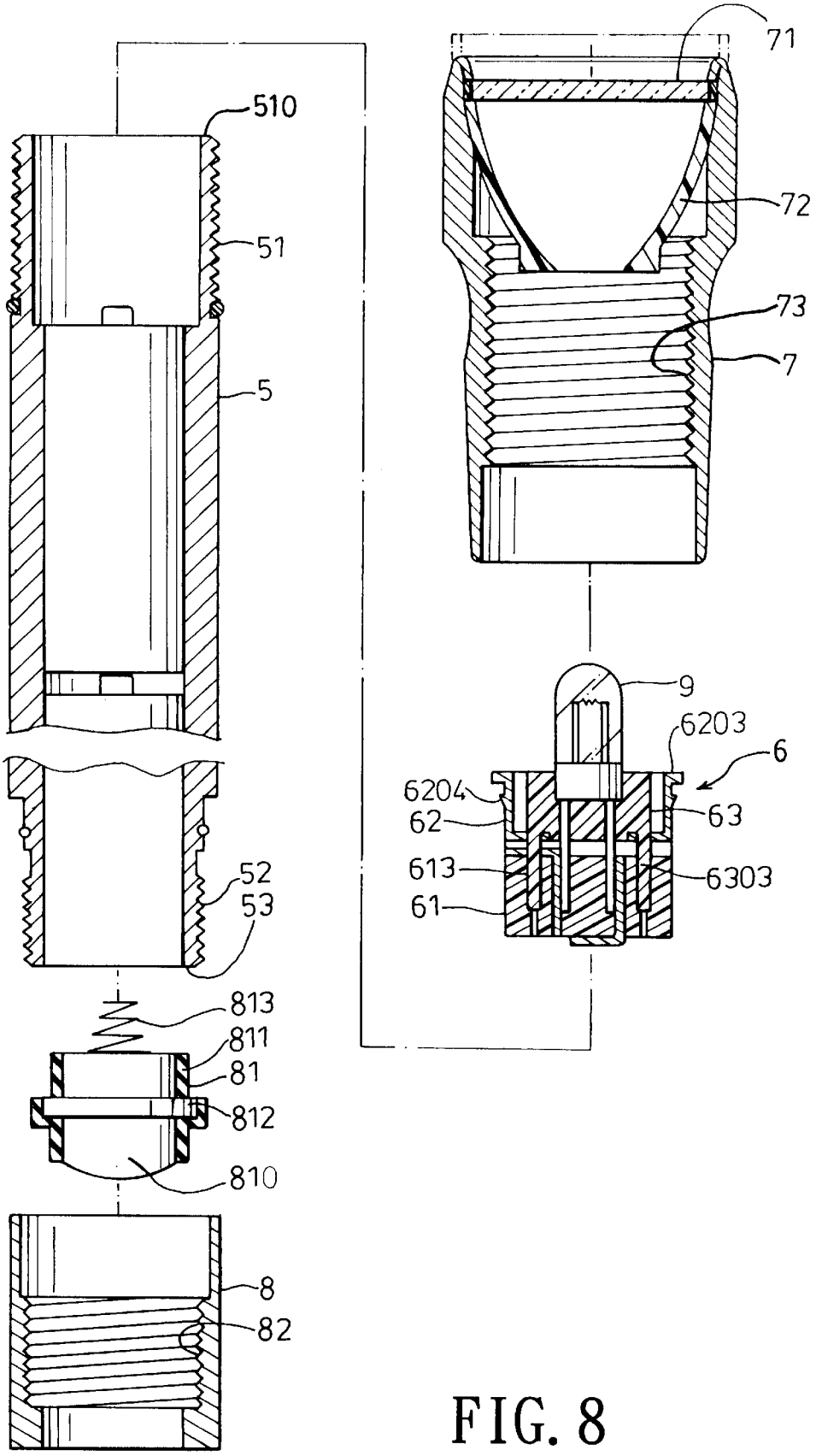
FIG. 8 is an exploded view of the preferred embodiment.

Referring to FIGS. 6,7, and 8, the preferred embodiment of a flashlight of this invention is shown to include a conductive barrel 5, a lamp 9*a*, a lamp base module 6, a head assembly 7, and a tail assembly 8.

As illustrated, the barrel 5 has top and bottom end portions 51,52 and is adapted for housing a battery unit 2 (see FIG. 6) therein.

The lamp 9*a* has a pair of lamp terminals 91,92.

The lamp base module 6 is mounted in the top end portion 51 of the barrel 5 and has the lamp 9*a* seated thereon. As best shown in FIG. 8, the lamp base module 6 includes a first insulator base member 61, a first conductor 611, a second conductor 612, a hollow conductive seat 62, and a second insulator base member 63.

The first insulator base member 61 has top and bottom sides (61T,61B), first and second terminal receiving holes 610 that extend from the top side (61T) toward the bottom side (61B), and a pair of base coupling holes 613 that extend from the top side (61T) toward the bottom side (61B).

The first conductor 611 is mounted in the first terminal receiving hole 610 of the first insulator base member 61, and has an end portion 6110 that extends radially along the top side (61T) of the first insulator base member 61.

The second conductor 612 is mounted in the second terminal receiving hole 610 of the first insulator base member 61, and has an end portion 6120 that extends radially along the bottom side (61B) of the first insulator base member 61 and that is adapted to establish electrical contact with the battery unit 2 housed in the barrel 5.

The conductive seat 62 is disposed above the first insulator base member 61, and has an upright wall portion 620 that contacts fittingly and electrically the barrel 5 (see FIG.

6), and a first flange portion 6201 that extends radially and inwardly from a bottom end of the upright wall portion 620 and that is disposed on top of the end portion 6110 of the first conductor 611 so as to establish electrical contact therewith.

The second insulator base member 63 is disposed in the conductive seat 62, and has top and bottom sides (63T,63B), and first and second terminal extension holes 6301 that extend from the top side (63T) to the bottom side (63B) and that are aligned respectively with the first and second terminal receiving holes 610 in the first insulator base member 61 in such a manner that the lamp terminals 91,92 of the lamp 9*a* extend respectively through the first and second terminal extension holes 6301 and into the first and second terminal receiving holes 610 of the first insulator base member 61. Under this condition, an electrical connection is established between the lamp terminals 91,92 and the first and second conductors 611,612.

The second insulator base member 63 further has a pair of coupling arms 6303 that extend into the base coupling holes 613 of the first insulator base member 61 for coupling together the first and second insulator base members 61,63.

In this embodiment, the first flange portion 6201 of the conductive seat 62 is formed with a pair of first arm extension holes 6202 that are aligned with the base coupling holes 613 and that permit the coupling arms 6303 of the second insulator base member 63 to extend therethrough. Preferably, the end portion 6110 of the first conductor 611 is formed with a second arm extension hole 6111 that is aligned with one of the first arm extension holes 6202 and one of the base coupling holes 613 in the first insulator base member 61 to permit one of the coupling arms 6303 to extend therethrough.

The conductive seat 62 further has a second flange portion 6203 that extends radially and outwardly from a top end of the upright wall portion 620 and that is seated on a distal end face 510 of the barrel 5 (see FIG. 8). The barrel 5 has an inner anodized coating. The upright wall portion 620 of the conductive seat 62 is formed with a pair of pointed protrusions 6204 that pierce through the inner anodized coating of the barrel 5 during mounting of the lamp base module 6 in the barrel 5 so as to establish electrical contact between the conductive seat 62 and the barrel 5.

The head assembly 7 is mounted on the top end portion 51 of the barrel 5, and includes a tubular head cap 73 mounted threadedly on the top end portion 51 of the barrel 5, and a parabolic reflector 72 disposed around the lamp 9*a,* and a lens member 71 mounted in the head cap 73 in front of the lamp 9*a*.

Figure 10:
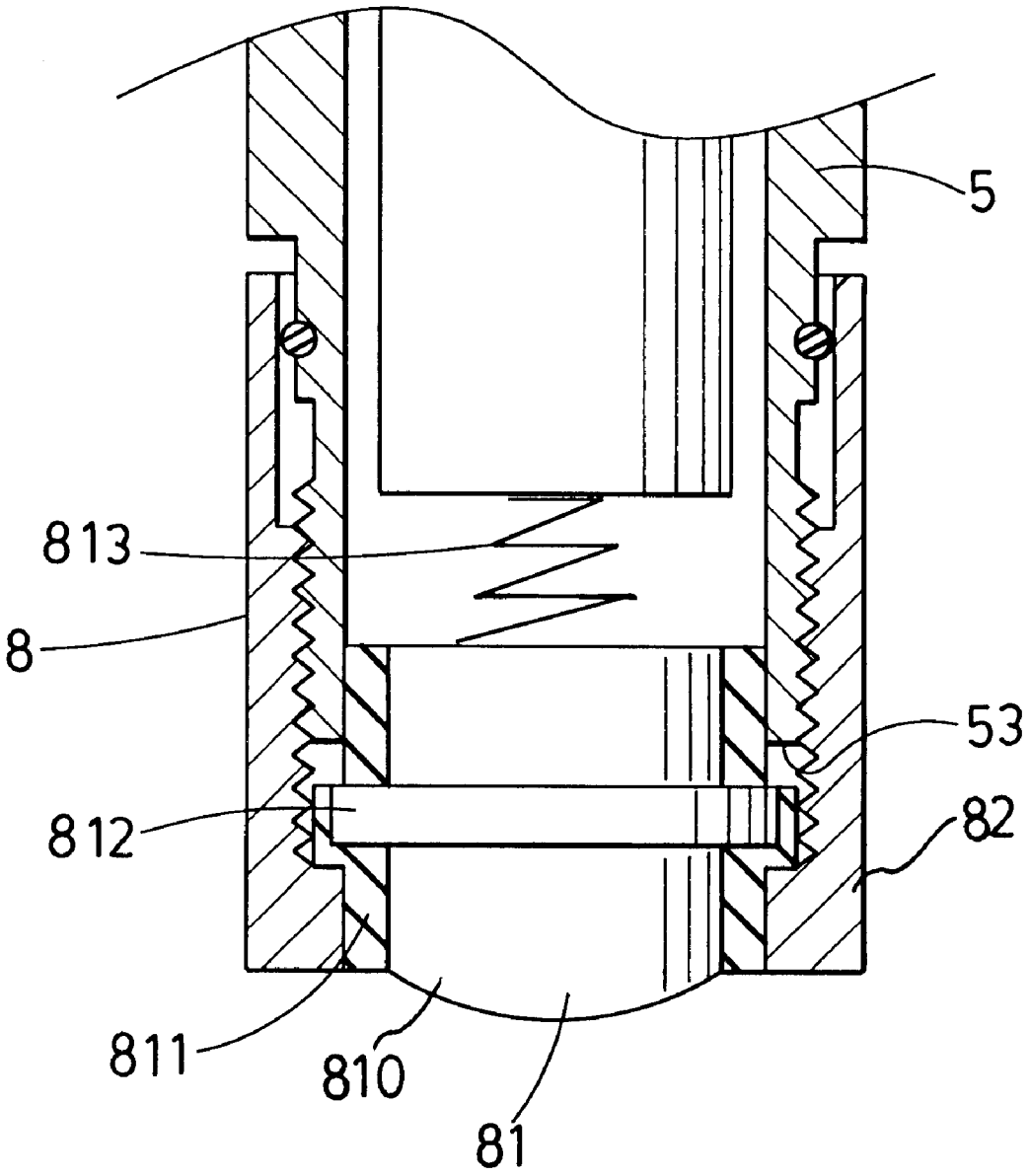
FIG. 10 is a fragmentary sectional view of the preferred embodiment, illustrating a tail assembly of the same.

Wither further reference to FIG. 10, the tail assembly 8 is mounted on the bottom end portion 52 of the barrel 5, and includes a tubular tail cap 82 mounted threadedly on the bottom end portion 52 of the barrel 5, and a switch unit 81 mounted in the tail cap 82 and adapted to establish electrical connection between the barrel 5 and the battery unit 2. The switch unit 81 preferably includes a conductive switch contact 810 slidably disposed in the tail cap 82 and formed with an annular contact flange 812 for contacting a distal end face 53 of the bottom end portion 52 of the barrel 5. The switch contact 810 is further provided with an insulator coating 811 such that electrical connection between the switch contact 810 and the barrel 5 is permitted only when the contact flange 812 abuts against the distal end face 53 of the bottom end portion 52 of the barrel 5 (see FIG. 6).

A conductive contact spring 813 is disposed in the barrel 5, and has one end abutting against the switch contact 811 and an opposite end adapted to contact electrically the battery unit 2 when the latter is disposed in the barrel 5. As best shown in FIG. 10, to activate the lamp 9*a,* the switch contact 810 can be depressed inwardly and axially with respect to the barrel 5 and against biasing action of the spring 813 so as to contact the distal end face 53 of the barrel with the contact flange 812.

Figure 9:
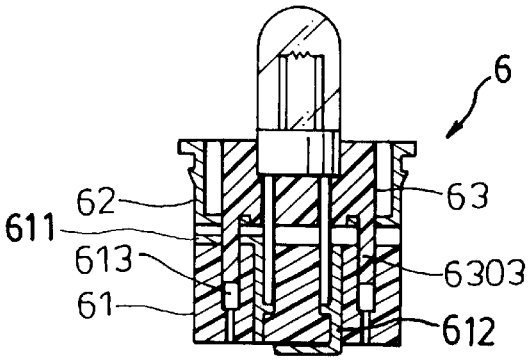
FIG. 9 is a sectional view of the lamp base module employed in a modified preferred embodiment.

In the embodiment of FIGS. 6 and 8, the coupling arms 6303 are longer than the depths of the base coupling holes 613 such that by rotating the head cap 73, the reflector 72 can push the second insulator base member 63 to break electrical contact between the end portion 6110 of the first conductor 61 and the first flange portion 6201 of the conductive seat 62. In the embodiment of FIG. 9, the coupling arms 6303 are shorter than the depths of the base coupling holes 613 so that constant electrical contact between the end portion 6110 of the first conductor 61 and the first flange portion 6201 of the conductive seat 62 can be ensure, regardless of the position of the head cap 73 on the barrel 5 (see FIG. 8). Control of the activation of the lamp 9*a* resides solely on the state of the switch unit 81.

The advantages provided by the flashlight of the present invention are as follows:

(1) Assembly of the lamp base module 6 in the barrel 5 is simple, thereby eliminating those drawbacks that result during assembly of the lamp base module employed in the conventional flashlights.

(2) When the lamp base module 6 is inserted into the barrel 5, the pointed protrusions 6204 of the conductive seat 62 pierce through the inner anodized coating of the barrel 5 so as to establish electrical contact between the conductive seat 62 and the barrel 5. Thus, the inner anodized coating of the barrel 5 need not be manually etched, thereby shortening the assembly time for the flashlight of the present invention.

(3) The lamp base module 6 is immobilized in the barrel 5 due to tight engagement of the pointed protrusions 6204 of the conductive seat 62 with the inner surface of the barrel 5, and by virtue of engagement between the second flange portion 6203 of the conductive seat 62 and the distal end face 510 of the barrel 5. Thus, the need to machine the barrel 5 for engagement of the conductive seat 62 with the barrel 5 is obviated.

With this invention thus explained, it is apparent that numerous modifications and variations can be made without departing from the scope and spirit of this invention. It is thereof intended that this invention be limited only as indicated in the appended claims.

I claim:

1. A lamp base module adapted to be mounted in a conductive barrel of a flashlight, and adapted to for seating of a lamp thereon, the lamp having a pair of lamp terminals, said lamp base module comprising:

a first insulator base member having top and bottom sides, first and second terminal receiving holes that extend from said top side toward said bottom side, and a pair of base coupling holes that extend from said top side toward said bottom side;

a first conductor mounted in said first terminal receiving hole, and having an end portion that extends radially along said top side of said first insulator base member;

a second conductor mounted in said second terminal receiving hole, and having an end portion that extends radially along said bottom side of said first insulator base member;

a hollow conductive seat disposed above said first insulator base member, and having an upright wall portion adapted to be establish electrical contact with the barrel, and a first flange portion that extends radially and inwardly from a bottom end of said upright wall portion and that is disposed on top of said end portion of said first conductor so as to establish electrical contact therewith; and a second insulator base member disposed in said conductive seat, and having top and bottom sides, and first and second terminal extension holes that extend from said top side to said bottom side and that are aligned respectively with said first and second terminal receiving holes so as to be adapted to permit the lamp terminals to extend respectively through said first and second terminal extension holes and into said first and second terminal receiving holes for enabling electrical connection between the lamp terminals and said first and second conductors, said second insulator base member further having a pair of coupling arms that extend into said base coupling holes for coupling together said first and second insulator base members.

2. The lamp base module as defined in claim 1, wherein said first flange portion of said conductive seat is formed with a pair of first arm extension holes that are aligned with said base coupling holes and that permit said coupling arms to extend therethrough.

3. The lamp base module as defined in claim 2, wherein said end portion of said first conductor is formed with a second arm extension hole that is aligned with one of said first arm extension holes and one of said base coupling holes to permit one of said coupling arms to extend therethrough.

4. A lamp base module adapted to be mounted in a conductive barrel of a flashlight, and adapted for seating of a lamp thereon, the lamp having a pair of lamp terminals, said lamp base module comprising:

a first insulator base member having top and bottom sides, first and second terminal receiving holes that extend from said top side toward said bottom side, and a pair of base coupling holes that extend from said top side toward said bottom side;

a first conductor mounted in said first terminal receiving hole, and having an end portion that extends radially along said top side of said first insulator base member;

a second conductor mounted in said second terminal receiving hole, and having an end portion that extends radially along said bottom side of said first insulator base member;

a hollow conductive seat disposed above said first insulator base member, and having an upright wall portion adapted to establish electrical contact with the barrel, a first flange portion that extends radially and inwardly from a bottom end of said upright wall portion and that is disposed on top of said end portion of said first conductor so as to establish electrical contact therewith, and a second flange portion that extends radially and outwardly from a top end of said upright wall portion and that is adapted to be seated on a distal end face of the barrel; and a second insulator base member disposed in said conductive seat, and having top and bottom sides, and first and second terminal extension holes that extend from said top side to said bottom side and that are aligned respectively with said first and second terminal receiving holes so as to be adapted to permit the lamp terminals to extend respectively through said first and second terminal extension holes and into said first and second terminal receiving holes for enabling electrical connection between the lamp terminals and said first and second conductors, said second insulator base member further having a pair of coupling arms that extend into said base coupling holes for coupling together said first and second insulator base members.

5. A lamp base module adapted to be mounted in a conductive barrel of a flashlight, and adapted for seating of a lamp thereon, the lamp having a pair of lamp terminals, said lamp base module comprising:

a first insulator base member having top and bottom sides, first and second terminal receiving holes that extend from said top side toward said bottom side, and a pair of base coupling holes that extend from said top side toward said bottom side;

a first conductor mounted in said first terminal receiving hole, and having an end portion that extends radially along said top side of said first insulator base member;

a second conductor mounted in said second terminal receiving hole, and having an end portion that extends radially along said bottom side of said first insulator base member;

a hollow conductive seat disposed above said first insulator base member, and having an upright wall portion adapted to establish electrical contact with the barrel, and a first flange portion that extends radially and inwardly from a bottom end of said upright wall portion and that is disposed on top of said end portion of said first conductor so as to establish electrical contact therewith; and a second insulator base member disposed in said conductive seat, and having top and bottom sides, and first and second terminal extension holes that extend from said top side to said bottom side and that are aligned respectively with said first and second terminal receiving holes so as to be adapted to permit the lamp terminals to extend respectively through said first and second terminal extension holes and into said first and second terminal receiving holes for enabling electrical connection between the lamp terminals and said first and second conductors, said second insulator base member further having a pair of coupling arms that extend into said base coupling holes for coupling together said first and second insulator base members, wherein said upright wall portion is formed with an anodized coating piercing pointed protrusion that is adapted to pierce through an inner anodized coating of the barrel so as to establish electrical contact with the barrel.

6. A flashlight comprising:

a conductive barrel having top and bottom end portions and adapted for housing a battery unit therein;

a lamp having a pair of lamp terminals; and a lamp base module mounted in said top end portion of said barrel, said lamp base module including a first insulator base member having top and bottom sides, first and second terminal receiving holes that extend from said top side toward said bottom side, and a pair of base coupling holes that extend from said top side toward said bottom side, a first conductor mounted in said first terminal receiving hole, and having an end portion that extends radially along said top side of said first insulator base member, second conductor mounted in said second terminal receiving hole, and having an end portion that extends radially along said bottom side of said first insulator base member and that is adapted to establish electrical contact with the battery unit housed in said barrel, a hollow conductive seat disposed above said first insulator base member, and having an upright wall portion that contacts fittingly and electrically said barrel, and a first flange portion that extends radially and inwardly from a bottom end of said upright wall portion and that is disposed on top of said end portion of said first conductor so as to establish electrical contact therewith, and a second insulator base member disposed in said conductive seat, and having top and bottom sides, and first and second terminal extension holes that extend from said top side to said bottom side and that are aligned respectively with said first and second terminal receiving holes, said lamp terminals extending respectively through said first and second terminal extension holes and into said first and second terminal receiving holes, and establishing electrical connection with said first and second conductors, respectively, said second insulator base member further having a pair of coupling arms that extend into said base coupling holes for coupling together said first and second insulator base members.

7. The flashlight as defined in claim 6, wherein said first flange portion of said conductive seat is formed with a pair of first arm extension holes that are aligned with said base coupling holes and that permit said coupling arms to extend therethrough.

8. The flashlight as defined in claim 7, wherein said end portion of said first conductor is formed with a second arm extension hole that is aligned with one of said first arm extension holes and one of said base coupling holes to permit one of said coupling arms to extend therethrough.

9. A flashlight comprising:

a conductive barrel having top and bottom end portions and adapted for housing a battery unit therein;

a lamp having a pair of lamp terminals; and a lamp base module mounted in said top end portion of said barrel, said lamp base module including a first insulator base member having top and bottom sides, first and second terminal receiving holes that extend from said top side toward said bottom side, and a pair of base coupling holes that extend from said top side toward said bottom side, a first conductor mounted in said first terminal receiving hole, and having an end portion that extends radially along said top side of said first insulator base member, a second conductor mounted in said second terminal receiving hole, and having an end portion that extends radially along said bottom side of said first insulator base member and that is adapted to establish electrical contact with the battery unit housed in said barrel, a hollow conductive seat disposed above said first insulator base member, and having an upright wall portion that contacts fittingly and electrically said barrel, a first flange portion that extends radially and inwardly from a bottom end of said upright wall portion and that is disposed on top of said end portion of said first conductor so as to establish electrical contact therewith, and a second flange portion that extends radially and outwardly from a top end of said upright wall portion and that is adapted to be seated on a distal end face of said barrel, and a second insulator base member disposed in said conductive seat, and having top and bottom sides, and first and second terminal extension holes that extend from said top side to said bottom side and that are aligned respectively with said first and second terminal receiving holes, said lamp terminals extending respectively through said first and second terminal extension holes and into said first and second terminal receiving holes, and establishing electrical connection with said first and second conductors, respectively, said second insulator base member further having a pair of coupling arms that extend into said base coupling holes for coupling together said first and second insulator base members.

10. The flashlight as defined in claim 6, wherein said barrel has an inner anodized coating, said upright wall being formed with an anodized coating piercing pointed protrusion that pierces through said inner anodized coating of said barrel so as to establish electrical contact between said conductive seat and said barrel.

11. The flashlight as defined in claim 6, further comprising a head assembly mounted on said top end portion of said barrel, said head assembly including a head cap mounted threadedly on said barrel, and a parabolic reflector and a lens member mounted in said head cap.

12. The flashlight as defined in claim 6, further comprising a tail assembly mounted on said bottom end portion of said barrel, said tail assembly including a tail cap mounted threadedly on said barrel, and a switch unit mounted in said tail cap and adapted to establish electrical connection between said barrel and the battery unit.

13. The flashlight as defined in claim 12, wherein said switch unit includes:

a conductive switch contact slidably disposed in said tail cap, said switch contact being formed with an annular contact flange for contacting a distal end face of said bottom end portion of said barrel, said switch contact being further provided with an insulator coating such that electrical connection between said switch contact and said barrel is permitted only when said contact flange abuts against said distal end face of said bottom end portion of said barrel; and a conductive contact spring disposed in said barrel and having one end abutting against said switch contact and an opposite end adapted to contact electrically the battery unit.

* * * * *